United States Patent [19]

Hudson et al.

[11] Patent Number: 4,618,444

[45] Date of Patent: Oct. 21, 1986

[54] HOUSEHOLD LAUNDRY DETERGENT WITH DUAL STRENGTH BLEACH

[75] Inventors: John O. Hudson, Garden Grove; Mickey M. Schleien, Culver City; John Barrett, La Mirada, all of Calif.

[73] Assignee: Purex Corporation, Lakewood, Calif.

[21] Appl. No.: 651,579

[22] Filed: Sep. 17, 1984

[51] Int. Cl.[4] ..... C11D 17/00; B08D 3/00

[52] U.S. Cl. ..... 252/92; 8/137; 206/219; 220/23; 215/6; 215/227

[58] Field of Search ..... 252/90, 92; 206/219; 220/23; 215/6, 227; 8/137

[56] References Cited

U.S. PATENT DOCUMENTS

| | | | |
|---|---|---|---|
| 1,466,593 | 8/1923 | Kirchmer, Jr. | 206/237 |
| 1,657,312 | 1/1928 | McEldowney | 215/6 |
| 2,011,399 | 8/1935 | Driscoll | 206/47 |
| 2,048,219 | 7/1936 | Putter | 215/8 |
| 2,086,119 | 7/1937 | Corin | 215/37 |
| 2,250,666 | 7/1941 | Godefroy | 215/48 |
| 2,302,933 | 11/1942 | Barol | 215/6 |
| 2,310,491 | 2/1943 | Molow | 215/6 |
| 2,334,546 | 11/1943 | Davis | 206/47 |
| 2,352,951 | 7/1944 | Geria | 215/6 |
| 2,493,922 | 1/1950 | Miller | 215/6 |
| 2,619,448 | 11/1952 | Larsen | 195/54 |
| 2,766,796 | 10/1956 | Tupper | 150/5 |
| 2,781,141 | 2/1957 | Lucien | 215/6 |
| 2,896,810 | 7/1959 | Mulvenna | 220/234 |
| 2,941,689 | 6/1960 | Black | 220/23 |
| 2,979,193 | 4/1961 | Fredette | 206/47 |
| 2,985,289 | 5/1961 | U'Ren | 206/47 |
| 3,079,022 | 2/1963 | Tompkins | 215/6 |
| 3,095,109 | 6/1963 | Exton | 220/23 |
| 3,128,878 | 4/1964 | Ring | 206/42 |
| 3,195,719 | 7/1965 | Giesler | 206/216 |
| 3,241,738 | 3/1966 | Freiman | 229/37 R |
| 3,307,687 | 3/1967 | Steinman | 206/47 |
| 3,311,226 | 3/1967 | Oliver | 206/47 |
| 3,347,403 | 10/1967 | Lehrman | 220/17 |
| 3,458,446 | 7/1969 | Diaz | 252/99 |
| 3,567,105 | 3/1971 | McFarlin | 229/15 |
| 3,581,927 | 6/1971 | Langdon | 220/23 |
| 3,616,897 | 11/1971 | Vrana | 206/47 R |
| 3,732,999 | 5/1973 | Rounkles | 215/6 |
| 3,768,688 | 10/1973 | Linke | 220/23 |
| 3,797,646 | 3/1974 | Horne | 206/47 A |
| 3,840,136 | 10/1974 | Lanfranconi et al. | 215/6 |
| 3,870,147 | 3/1975 | Orth | 206/222 |
| 3,893,280 | 7/1975 | King | 206/47 A |
| 3,901,386 | 8/1975 | Hennessey | 206/434 |
| 3,904,058 | 9/1975 | Rosenstein | 215/6 |
| 4,024,952 | 5/1977 | Leitz | 206/221 |
| 4,028,263 | 11/1981 | Gray | 252/95 |
| 4,114,784 | 9/1978 | Hough et al. | 220/408 |
| 4,116,878 | 9/1978 | Deutscher et al. | 252/99 |
| 4,123,376 | 10/1978 | Gray | 252/99 |
| 4,196,808 | 4/1980 | Pardo | 206/432 |
| 4,235,343 | 11/1980 | Thompson et al. | 215/6 |
| 4,264,007 | 4/1981 | Hunt | 206/219 |
| 4,286,711 | 9/1981 | Platt et al. | 206/216 |
| 4,294,397 | 10/1981 | Kohler | 229/27 |
| 4,319,614 | 3/1982 | Boice | 220/23 |
| 4,387,809 | 6/1983 | Botzier | 206/526 |
| 4,428,749 | 1/1984 | Morris | 252/174 |
| 4,505,407 | 3/1986 | Klutz, Jr. | 252/162 |

FOREIGN PATENT DOCUMENTS

| | | |
|---|---|---|
| 1269992 | 6/1968 | Fed. Rep. of Germany . |
| 2525878 | 2/1976 | Fed. Rep. of Germany . |
| 1568919 | 4/1969 | France . |

*Primary Examiner*—Paul Lieberman
*Assistant Examiner*—John F. McNally
*Attorney, Agent, or Firm*—William W. Haefliger

[57] ABSTRACT

The invention relates generally to products useful for home laundering, and more particularly to adjustable strength bleaching compositions, highly advantageous packaging of such compositions, and a method of bleaching involving the combination of the two. More specifically the invention relates to a home laundering composition containing a fabric-safe peroxygen bleach and an accompanying bleach activator system providing a convenient and effective means of achieving stronger bleaching action whenever desirable.

29 Claims, 25 Drawing Figures

HOUSEHOLD LAUNDRY DETERGENT WITH DUAL STRENGTH BLEACH

BACKGROUND OF THE INVENTION

This invention relates generally to products useful for home laundering, and more particularly to adjustable strength bleaching compositions, highly advantageous packaging of such compositions, and a method of bleaching involving the combination of the two. More specifically the invention relates to a home laundering composition containing a fabric-safe peroxygen bleach and an accompanying bleach activator system providing a convenient and effective means of achieving stronger bleaching action whenever desirable. The peroxygen bleach activated system of the invention takes advantage of the discovery that substantial concentrations of chlorides may coexist with a peroxygen bleach such as a monopersulfate without formation of effective amounts of hypochlorite, but with the addition of lesser amounts of bromides the combined halides participate synergistically in forming hypohalites in effective concentrations. More specifically, a laundry detergent system in accordance with the invention embodies a detergent containing a peroxygen bleach and which is safe for use on the majority of washable fabrics, together with a separate bleach activator system employing a synergistic combination of halide salts, part of which may be incorporated in the detergent, with the balance to be selectively added to effect stronger bleaching action.

Typical laundry wash temperatures in the United States continue to decline for various reasons; and with them, the bleaching ability of the oxygen bleaching agents in conventional all-fabric safe bleaches (e.g. sodium perborate). Such agents remain in wide use despite this fact, because of their efficacy at elevated temperatures, and their virtual inability to harm sensitive fabrics and dyes, regardless of the washing conditions. Chlorine bleaches on the other hand, though very potent even at low temperature, are well known to affect adversely many colored fabrics, and they often substantially reduce the efficacy of many fluorescent whitener agents contained in most detergent products.

The ability of peroxymonosulfate to oxidize halides to hypohalites and hypohalous acids; and to consequently boost the overall bleaching effectiveness, is well known in the industry. See U.S. Pat. No. 458,446; French Pat. No. 1,568,919; German Pat. No. 1,269,992, and U.S. Pat. No. 1,162,754.

There is also substantial prior art concerning methods of reducing fabric degradation when using a sodium bromide activated bleach. German Pat. No. 2,525,878 (see also U.S. Pat. No. 4,116,878) issued to Fritz Deutscher in January of 1976 teaches that textile degradation can be minimized by adding urea-or acetamide to a sodiumbromide activated peroxymonosulfate bleach. U.S. Pat. No. 4,123,376 issued to Frederick W. Gray in October of 1978 teaches that certain (other) N-hydrogen compounds inhibit destruction of dyes and overbleaching of dyed materials when used in a sodium bromide promoted peroxymonosulfate bleach composition. U.S. Pat. No. 4,028,263 issued to Frederick Gray in June of 1977 discloses certain flourescent whitening agents which are relatively stable in such a system for use in a detergent/bleach composition. Each of these patents refers only to bleaching enhancement from bromide ion addition, with no mention of the synergism and possible toxicity conditions which result from using a combination of chloride and bromide salts.

SUMMARY OF THE INVENTION

The present invention is based in part on the synergistic differential in bleaching performance obtained by using a combination of chloride and bromide ions above the sum of the bleaching performances obtained when each is used alone, and the facilitation of such combination for use in bleach activation, through unique packaging. In further contrast with the prior art, the present invention contemplates formulating the bromide salt as admixtures intimately commingled with the rest of the composition, with no discrete separation to provide for optional activation by the consumer. In addition to the versatility of the bleaching product disclosed herein, the product also has the advantage of being more stable and consequently more practical and saleable. The formulations previously disclosed were characteristically extremely unstable with the addition of water, which could occur either by passive transmission through the walls of the container in humid environments, or by inadvertant direct addition in use.

It is a major object of the present invention to provide a detergent with bleach having the performance characteristics of either of the above referenced bleach classes (oxygen and chlorine) and in a highly advantageous unitary package form. The latter typically comprises:

(a) a first openable container containing a bleach base that includes a peroxygen bleaching agent, and a first halide salt or salts, (b) a dispensing container containing a bleach activator composition including a second halide salt or salts, and forming a fitment, (c) the fitment carried by the first container to be readily detachable at least in part for dispensing the activator composition to controllably activate the bleach, forming hypohalites at the time of fabric laundering.

Such multiple container integration into one package serves to physically separate the bleach base and activator component, while enhancing stability as well as bleach strength adjustability. Also, storage, handling, use and effectiveness are facilitated.

Another object of this invention is to employ bromide and chloride ions in the combinable first and second halide salts which provides synergistic performance at the time of mixing during laundering, lower cost, and a somewhat lower degree of toxicity.

An additional object of this invention is to minimize the amount of halide activator which must be added for highest bleaching strength by incorporating part or all of the activator chloride at fabric safe levels in the detergent base. Still another object of this invention is to provide packaging for the product which physically separates the two components while maintaining convenience and aesthetics, such physical separation of activator from the base greatly enhancing the stability of the product, in addition to providing the versatility of adjustable strength.

As distinguished from the composition of the prior patents referred to above, the present invention is based in part on the synergistic differential in bleaching performance obtained by using a combination of chloride and bromide ions above the sum of the bleaching performances obtained when each is used alone. In further contrast, the prior patent disclosures referred to formulated the bromide salt as admixtures intimately commingled with the rest of the composition, with no discrete separation to provide for optional activation by the consumer. In addition to the inherent versatility of the bleaching product outlined in applicant's present disclosure, it also has the advantage of being much more stable and consequently more practical and saleable. The formulations previously disclosed are characterized as extremely unstable with the addition of water, which could occur either by passive transmission through the walls of the container in humid environments, or by inadvertant direct addition in use.

It is a yet further object to provide a single package design such that the activator dispensing container is not only attached to or integral with the detergent and bleach base container, but can be detached from or otherwise used separately from the detergent and bleach base product container. Such structural incorporation of the activator dispensing container into the detergent and bleach base container is referred to herein as a "fitment," the various unusually advantageous forms of which can best be described by reference to the following drawings and descriptions. Detergent and bleach base containers useful with the fitment can take the form of bottles or folding cartons as will appear.

In its fabric laundering method aspect, the invention basically contemplates the following steps:

(a) providing a first volume of a bleach base that incorporates a peroxygen bleaching agent, a portion of which is to be added to fabric laundry wash water, (b) providing a second volume of a bleach activator composition including a halide salt or salts in close transported association with said first volume of bleach base for presentation at the time of laundering, (c) and separating some of said activator composition from said close association with the bleach base volume and applying same to controllably activate the bleach base in said wash water containing said added portion of the bleach base.

Typically, detergent is incorporated with the bleach base, as will appear.

These and other objects and advantages of the invention as well as the details of an illustrative embodiment, will be more fully understood from the following specification and drawings, in which:

DRAWING DESCRIPTION

DETAILED DESCRIPTION

Figure 1:
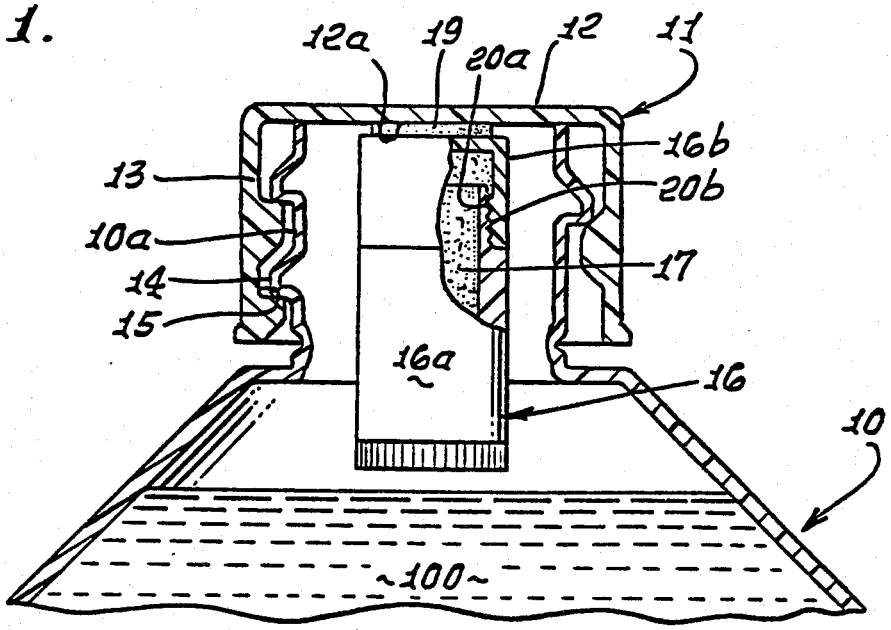
FIG. 1 is a vertical section showing a fitment adhered to the underside of a bottle overcap.

Referring first to the drawings, FIG. 1 illustrates a first container in the form of a bottle 10 having a threaded neck 10*a*, the bottle containing flowable bleach base 100 (as for example flowable dry granules), and typically for example, admixed with laundry detergent. The bottle has a removable cap 11 which in turn has a top horizontal wall 12 overlying the neck 10*a*, and a depending skirt 13 that extends in interfitting section with the neck. As shown, the skirt and neck have interfitting screw threads 14 and 15, other type connections being usable. The bottle, neck and cap may all consist of usable plastic material.

Also provided is a dispensing container as defined by fitment 16 containing a bleach activator composition 17 in flowable granule, tablet or other form. The fitment is indirectly carried by the bottle 10, and directly by the cap 11, to be readily detachable, at least in part, for dispensing the activator composition as at the time of fabric laundering. Thus, for example, removal of the cap 11 to provide access to the detergent and bleach base immediately presents the user with the fitment projecting from the removed cap, reminding the user that the fitment is ready to be used for application of activator composition to wash water receiving the detergent and bleach, as at the precise time of laundering and in conjunction therewith, to obtain a resulting higher quality adjustable bleaching of the fabric (due to the selection of relative amounts of bleach and activator).

As shown, the fitment has sub-container 16*a* and a sub-container 16*b*, the latter being retained by the top wall 12, and specifically to its underside 12*a* as by means of adhesive, double tape, VELCRO stripping, or other means, each of which is represented by the layer 19. In use, the subcontainer 16*a* may be removed from cap, as by reverse rotation to unscrew threads 20*a* and 20*b*. The activator carried by sub-container 16*a* is then exposed for use, for example, pouring into a measured volume of detergent and bleach granules to be added to wash water.

The dispensing device itself can be made from plastic, glass, metal or other suitable material for holding a liquid or a solid.

The detergent and bleach container 10 can be made from any suitable material including polyethylene, polypropylene, PVC and other plastics, glass, metal, or paperboard. In the case of paperboard, a suitable moisture barrier would be advantageous to maintain the product's effectiveness during storage and use.

Figure 2:
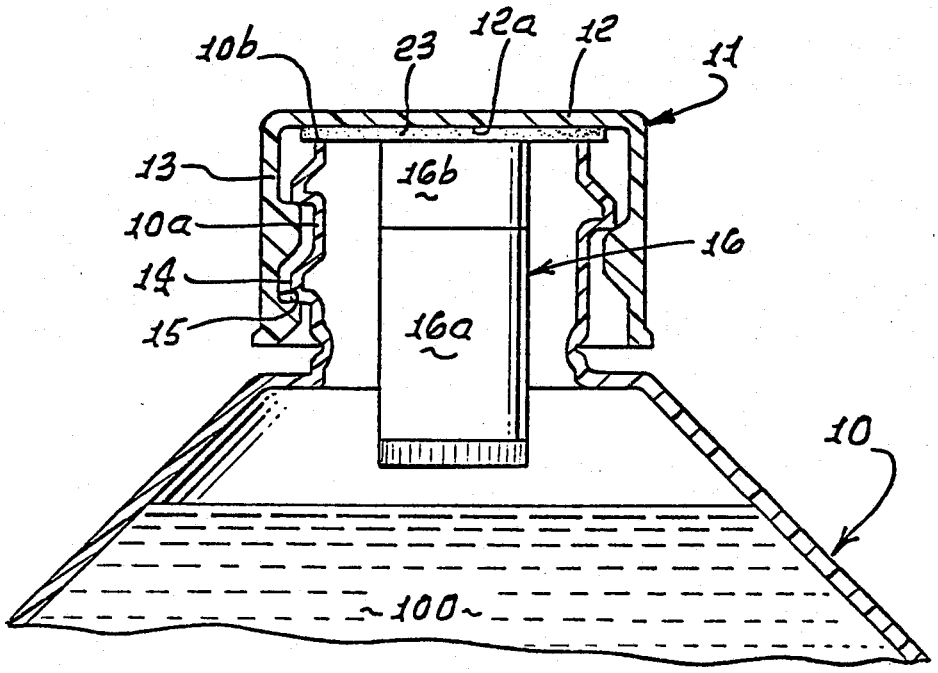
FIG. 2 is a vertical section showing a fitment cap seated on the bottle finish.

In FIG. 2, the elements bearing the same numbers as in FIG. 1 are the same. The fitment cap 16*b* in addition has a radially projecting flange 23 extending over the rim 10*b* of the bottle neck 10*a* and retained on that rim by the underside 12*a* of the bottle cap 11. Thus, the fitment 16 is completely detachable from the cap 11 when the bottle is removed from the neck 10*a*.

Figure 3:
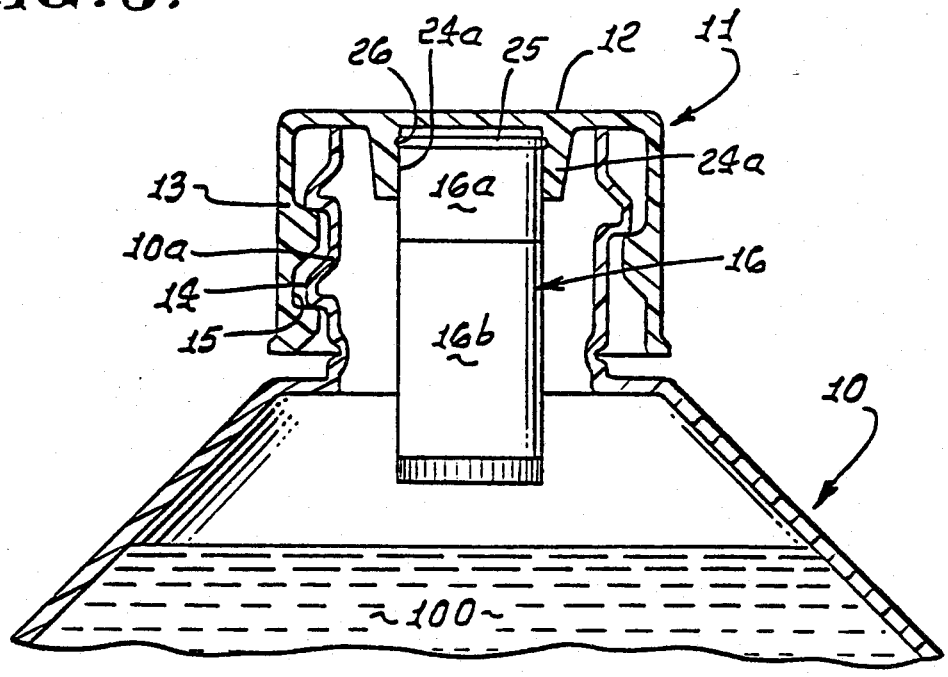
FIG. 3 is a section showing a fitment cap snapped into a friction sleeve in a bottle overcap.

In FIG. 3, the elements bearing the same numbers as in FIG. 1 are the same. The cap top wall 12 in addition has an integral sleeve 24*b* depending therefrom, within the bottle neck. The fitment cap 16*b* may extend telescopically into the sleeve bore 24*a*, and a flange 25 on the cap may removably snap into an annular recess 26 in the bore wall, as shown.

Figure 4:
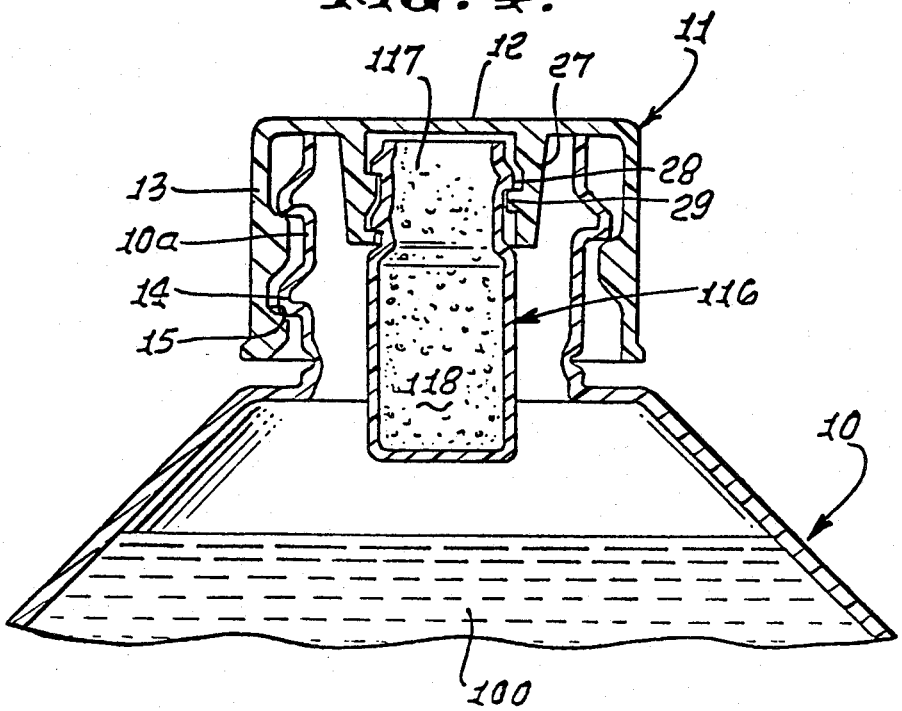
FIG. 4 is a section showing a fitment cap and is similar to FIG. 13.
Figure 13:
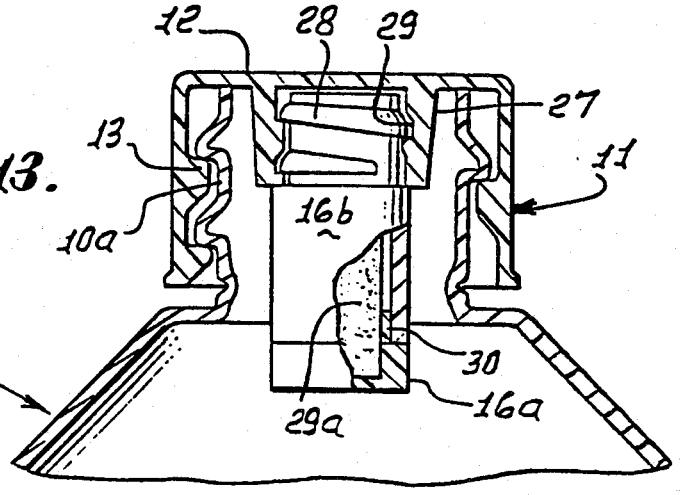
FIG. 13 is a section showing an inverted fitment thread connected into a double threaded overcap.

In FIG. 13, the elements bearing the same numbers as in FIG. 1 are the same. The cap top wall 12 in addition has an integral sleeve 27 depending therefrom, within the bottle neck. The fitment sub-container 16*b* in this embodiment has threaded connection with the sleeve 27, as afforded by threads 28 and 29. The fitment sub-container cap 16*a* is thus presented to the user. He may detach the cap 16*a* and pour activator 29*a* from the sub-container 16*b*. Both cap and subcontainer frictionally interfit at 30, other methods of connection being usable. FIG. 4 is like FIG. 13 except the fitment 116 is in one piece and has an open top at 117, directly below wall 12. Fitment thread 28 engages sleeve thread 29. Activator granules in the fitment appear at 118. Activator tablets may be used.

Figure 15:
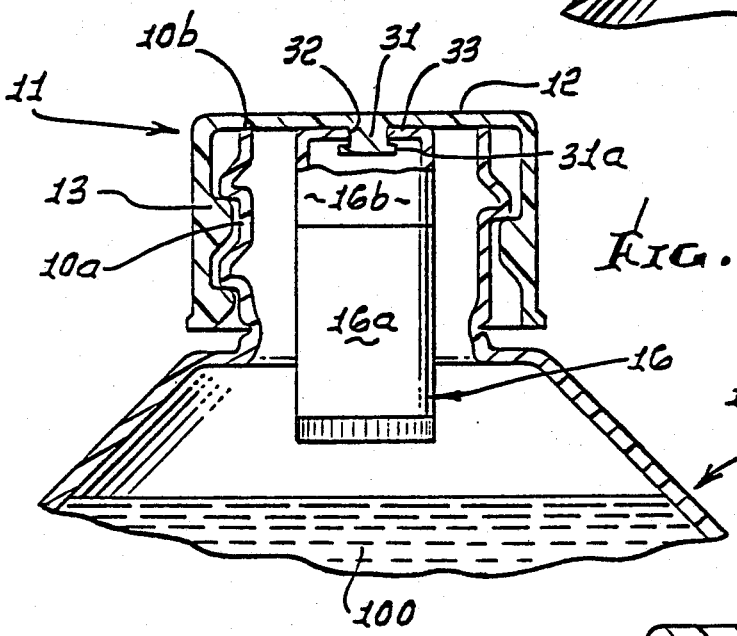
FIG. 15 is a section showing a fitment snap connected onto a plug in the bottle overcap.

In FIG. 15, the elements bearing the same numerals as in FIG. 1 are the same. The fitment cap 16*b* and the bottle cap top wall 12 include removably interfitting snap connection elements, as for example small flanged boss or plug 31 depending from top wall 12 and received through an opening 32 in the fitment cap top wall 33. Opening 32 is slightly smaller in diameter than the flange 31*a*, providing a snap-on interfit. Other forms of snap connection are usable.

Figure 12:
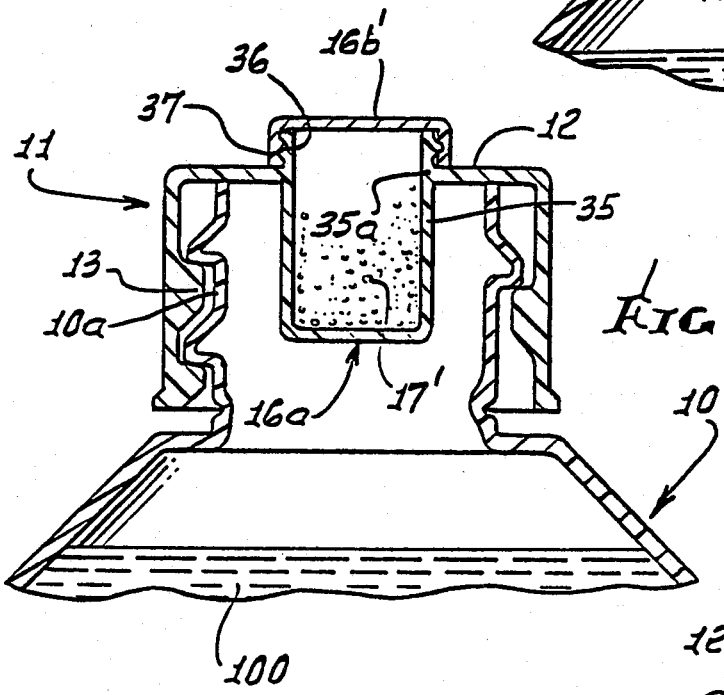
FIG. 12 is a section showing a fitment molded as an integral part of a bottle overcap.

In FIG. 12, the elements bearing the same numerals as in FIG. 1 are the same. The fitment sub-container 16*a* has a side wall 35 integrally molded with the bottle cap top wall 12, at 35*a*, and wall 35 projects and is externally threaded at the upper exterior side of the wall 12. Subcontainer cap 16*b*′ is internally threaded at 36 to engage the external thread 37 on wall 35, as shown. Thus, cap 16*b*′ is easily removable, exteriorly, to allow pouring or other dispensing of the activator 17′ which may consist of flowable granules, or may be in other form.

Figure 11:
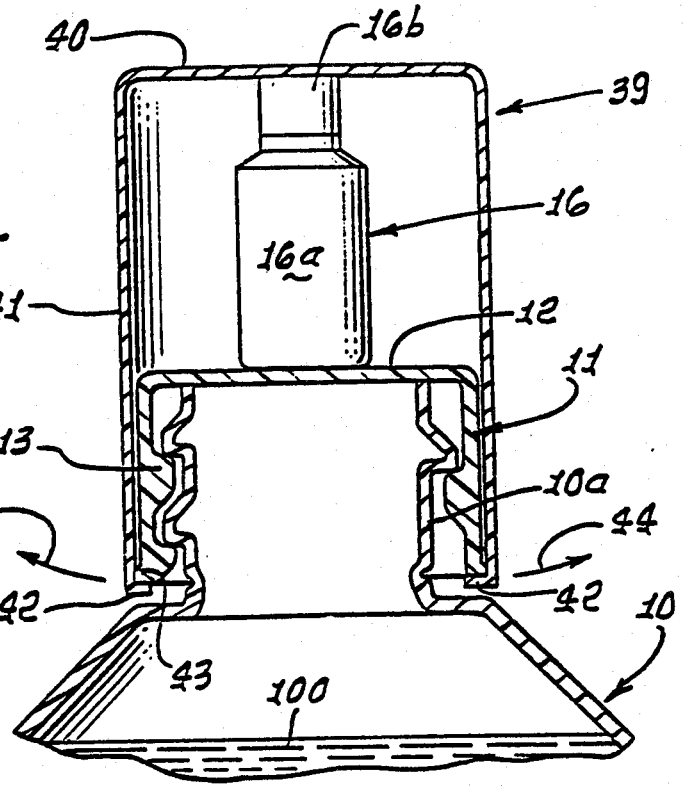
FIG. 11 is a section showing a fitment contained in a bottle snap-on overcap.

In FIG. 11, the fitment 16 is primarily (as for example completely) located outside and above the cap top wall 12, and auxiliary means is provided to retain the fitment in position, just above wall 12. In the example, such auxiliary means has the form of a thin-walled plastic overcap 39, having a top wall 40 located to compressively retain the fitment vertically between walls 40 and 12, as shown. The overcap depending skirt 41 is removably mounted on the bottle cap, so that it may be easily detached. As shown, two lips 42 engage the lower rim 43 of the cap 11, and may be pulled free (see arrows 44) to release the overcap, providing access to the fitment 16.

Figure 14:
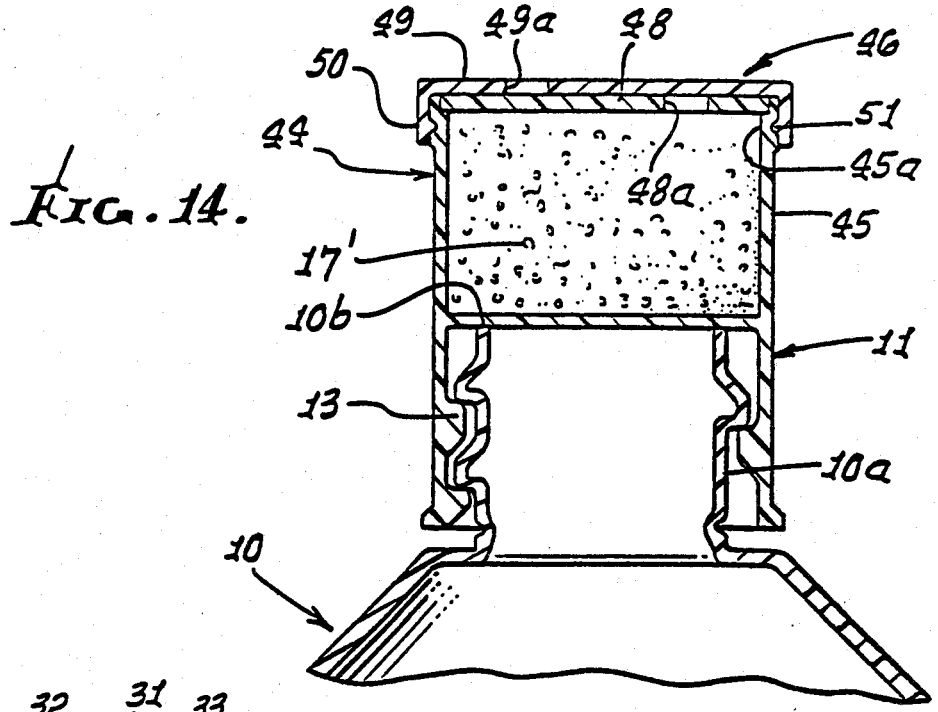
FIG. 14 is a section showing a fitment thread connected over the bottle finish, the fitment having a cap attached to a rotary dispensing closure.

In FIG. 14, the fitment 44 includes a sub-container 45 integral with the bottle cap 11, and extending thereabove. Sub-container cap structure 46 is connected to the sub-container 45, to allow dispensing of the flowable activator composition. As shown, the cap structure includes first and second walls 48 and 49, each containing ports 48*a* and 49*a* normally out of registration. The walls extend adjacent one another, and are relatively rotatable (i.e. wall 49 may rotate relative to wall 48, for example) to bring ports 48*a* and 49*a* into registration, allowing dispensing of activator. Wall 49 is shown as having a skirt 50 with annular detent connection at 51 to the subcontainer wall 45*a*, allowing rotation ofthe skirt and wall 49. Flowable granules are indicated at 17′.

Figure 5:
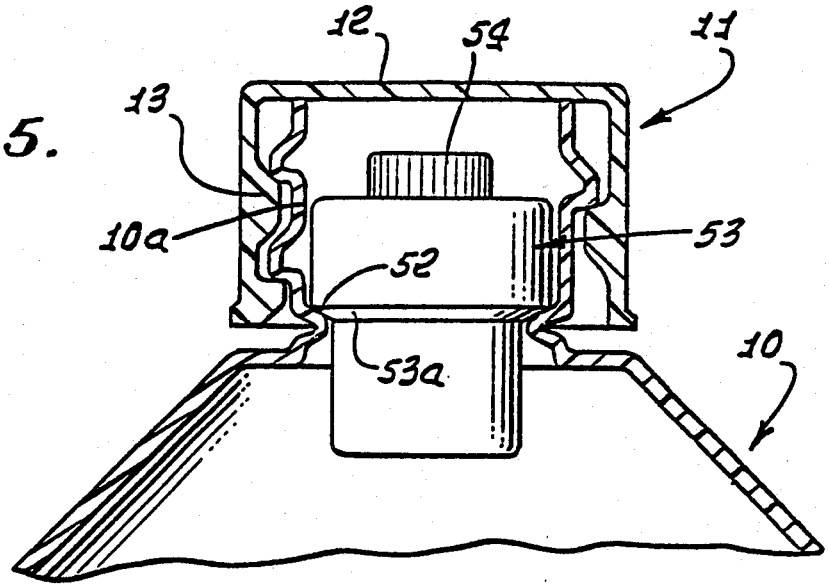
FIG. 5 is a section showing a fitment flange engaging an indent on a bottle neck.
Figure 6:
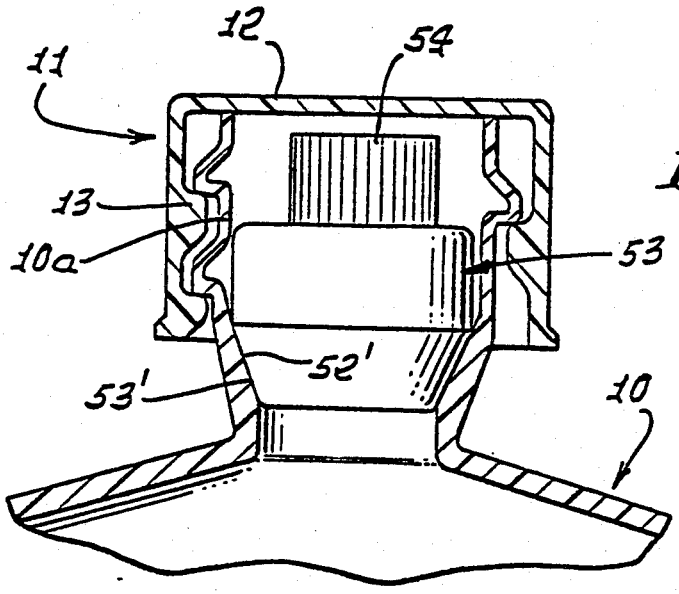
FIG. 6 is a section showing a tapered fitment wedged into a bottle tapered neck.

In FIG. 5, the bottle neck 10*a* has an internal ledge or ledges 52 seating the fitment sub-container 53. The latter has a flanged undersurface 53*a* engaging the ledge, which may be annular. In FIG. 6, the modified ledge 52′ tapers downwardly, and cooperatively engages or seats the frustoconical outer surface 53′ of the fitment sub-container 53, to position the fitment. Caps for the fitment sub-container appear at 54 in FIGS. 5 and 6, and the fitments are loosely contained within the bottle neck to be completely removable when the bottle cap 11 is removed.

Figure 9:
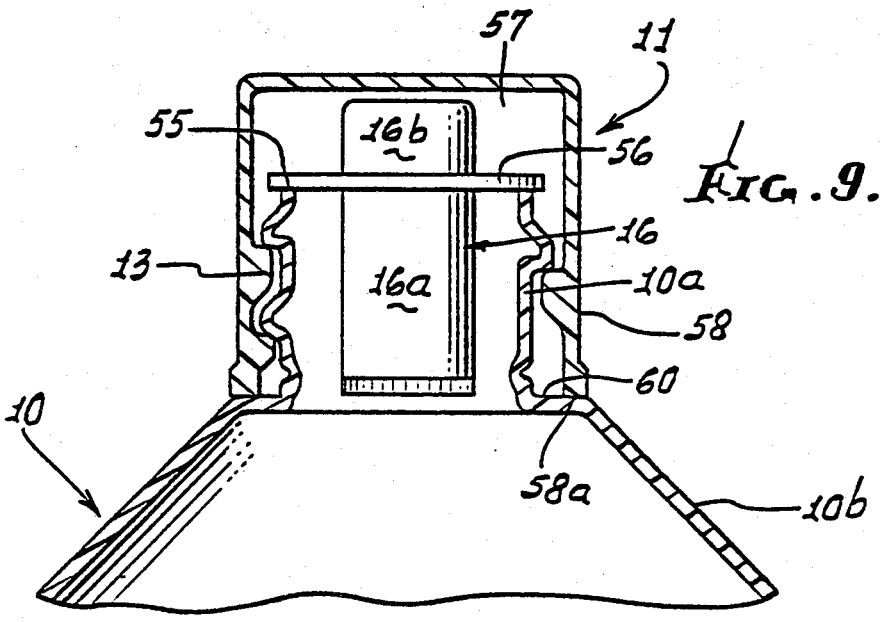
FIG. 9 is a section showing a collar under a fitment cap engaging a bottle sealing surface, and the bottle cap sealing on a bottle shoulder.
Figure 10:
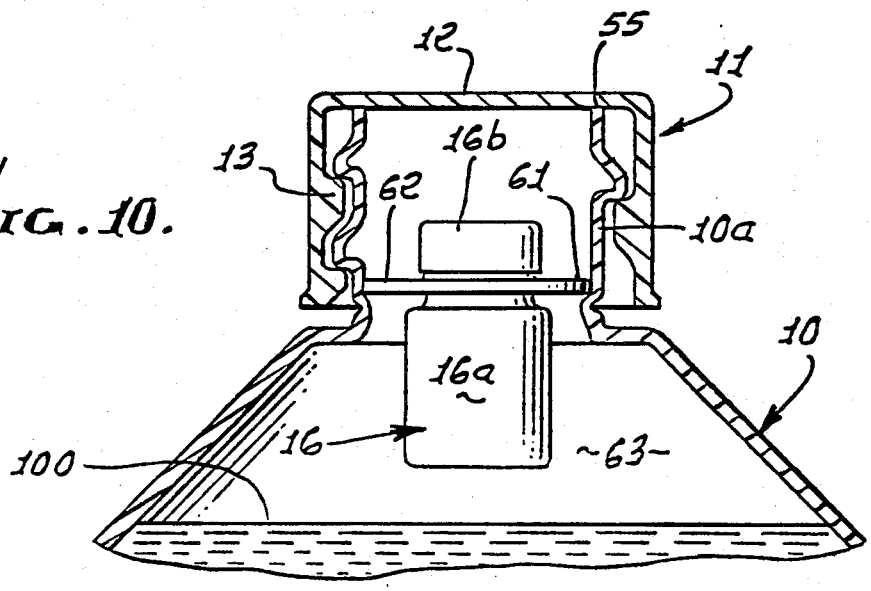
FIG. 10 is a section showing a collar under a fitment cap engaging an indent on a bottle neck.

In FIG. 9, the bottle neck 10*a* has an upper rim 55, and an external flange 56 on the fitment 16 seats on that rim to retain the fitment sub-container 16*a* within the neck 10*a*, and the sub-container cap 16*b* projecting upwardly within the cap upper interior 57. The lower edge or rim 58*a* of the cap skirt 58 seats and seals against the bottle shoulder 60 between neck 10*a* and bottle wall taper 10*b*. In FIG. 10, the bottle neck 10*a* has an internal integral flange or shoulder 61; and an external flange 62 on the fitment 16 seats on that flange 61. The flange is annular, and the fitment sub-container 16*a* projects downwardly through the flange into the bottle upper interior 63. Top wall 12 of cap 11 seats and seals on the upper rim 55 of the neck 10*a*.

Figure 8:
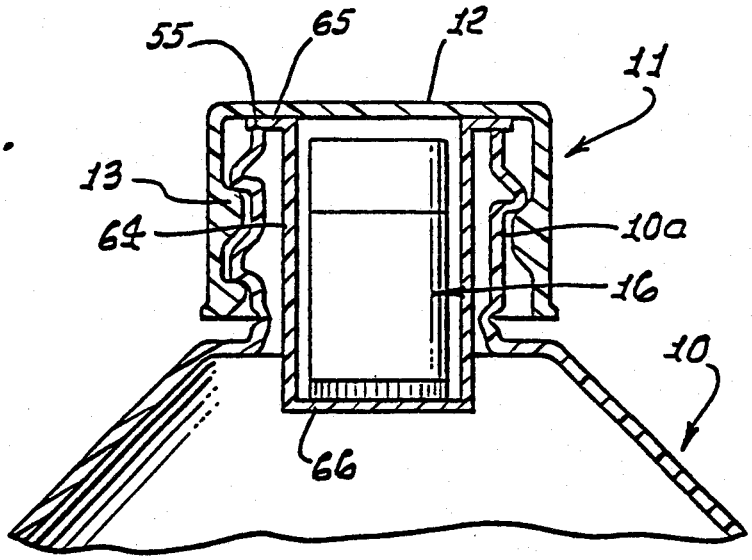
FIG. 8 is a section showing an inner activator container seated inside a flanged cup fitment which engages the top of the bottle finish.

In FIG. 8, a receptacle 64 has an external flange 65 seating on the bottle neck rim, and retained in position by the top wall 12 of the cap 11. The upwardly opening receptacle extends downwardly within the bottle neck 10*a*, and fitment 16 is loosely received in the receptacle and confined between bottom wall 66 of the receptacle and top wall 12. Receptacle 64 is removable after cap 11 is removed.

Figure 7:
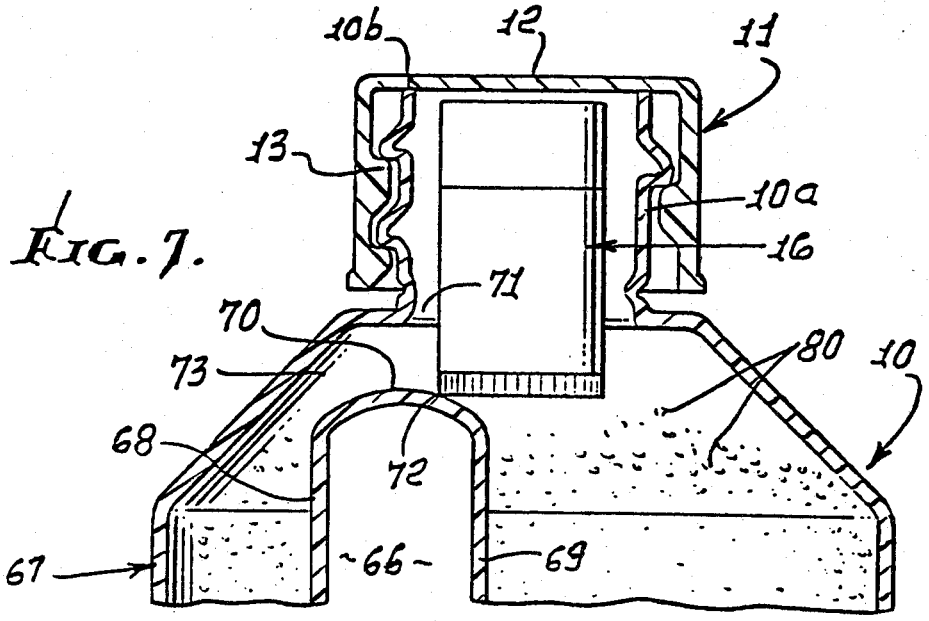
FIG. 7 is a section showing a fitment seated on a shelf formed in the bottle, as an indent or part of the bottle handle.
Figure 16:
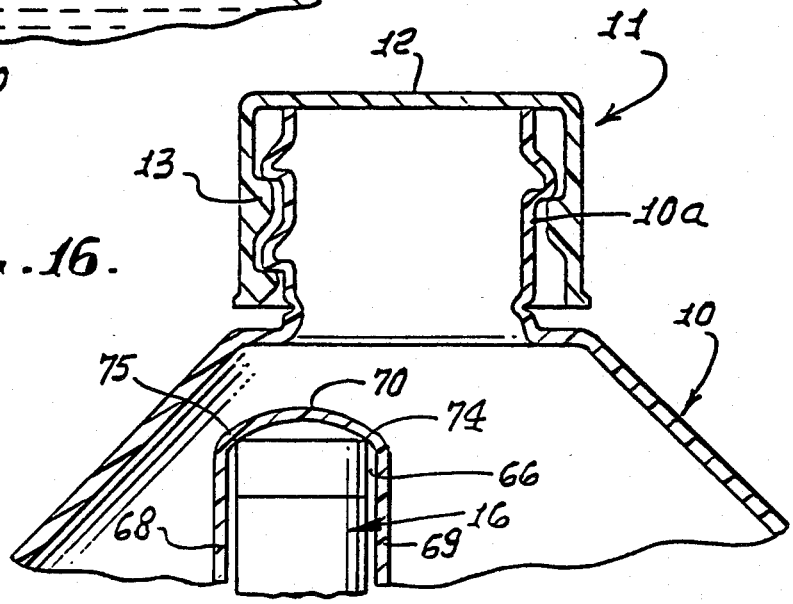
FIG. 16 is a section showing a fitment received within a recess formed in the bottle as an indent or handle.

In FIG. 7, the bottle 10 has side wall structure that forms a lateral hand reception opening 66 and a manually graspable handle 67 associated with that opening. The wall structure includes vertical walls 68 and 69, and wall upper portion 70 presented internally of the bottle and generally upwardly toward neck 10*a* and neck opening 71. The fitment 16 is seated at 72 on wall upper portion 70, within upper interior 73 of the bottle, and also extends upwardly into and within the neck opening 71, as shown. The fitment may be sufficiently large in diameter so as to be retained in position by the neck and by the wall portion 70. The opening 66 may be merely an indent, and other than associated with a handle. See also flowable detergent and bleach granules at 80, filling the bottle. In FIG. 16, the fitment 16 is received within the opening or indent 66, removably retained as by frictional engagement with the wall structure, as at points 74 and 75.

Figure 17:
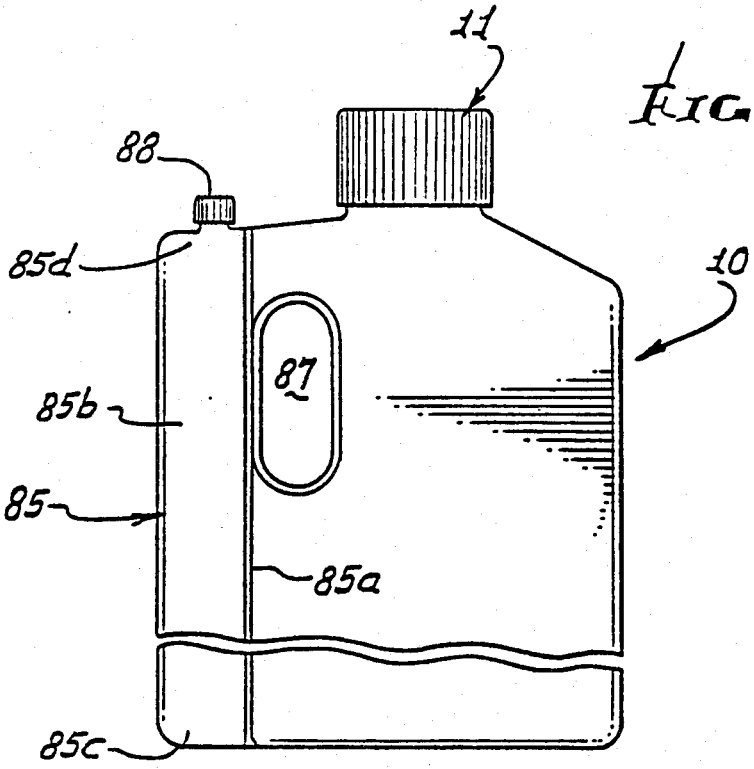
FIG. 17 is a vertical elevation showing a fitment molded as an integral part of a bottle, thereby forming a dual chambered container.

In FIG. 17, the fitment 85 extends externally of the bottle 10 and is attached thereto, as per example at the vertical location 85*a*, merging with the bottle side wall. Thus, the vertically elongated fitment may include a portion 85*b* forming a bottle handle associated with lateral opening 87 through the bottle for finger reception. The fitment is shown to extend upwardly from a location 85*c* near the bottom of the bottle to a location 85*d* near the top of the bottle. Fitment cap 88 is exposed externally of the bottle and its cap 11, and is offset laterally from cap 11, so that if cap 88 is removed, the flowable activator contents of the fitment container can be poured onto fabric to be washed, or into detergent and bleach granules to be added to the wash, and if cap 88 is replaced and cap 11 removed, bleach can be poured into the wash water.

Figure 18:
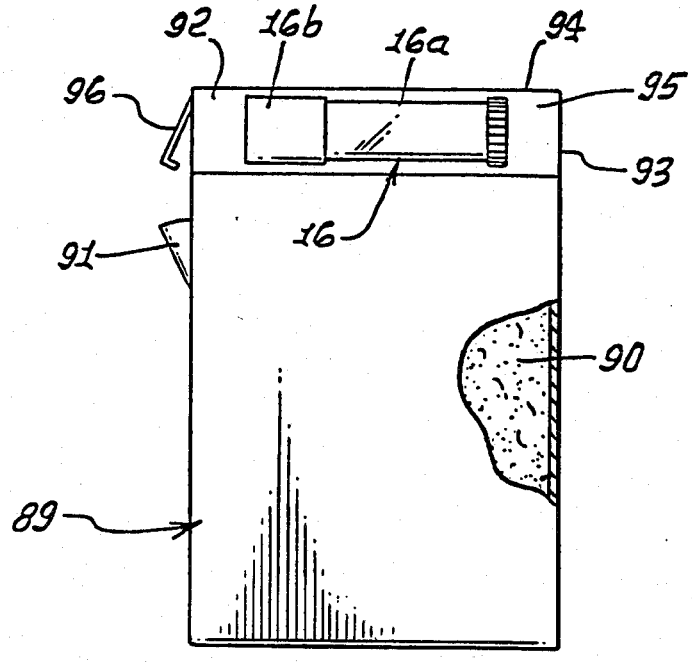
FIG. 18 is a vertical elevation, partly in section, showing a fitment contained in a separate compartment that is an integral part of a folding carton used to hold the dry bleach base.
Figure 19A:
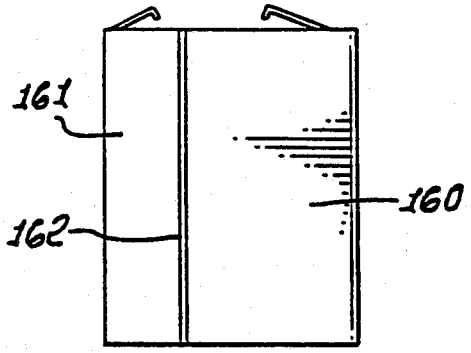
FIGS. 19*a*–19*d* show alternative fitments associated with cartons.
Figure 19B:
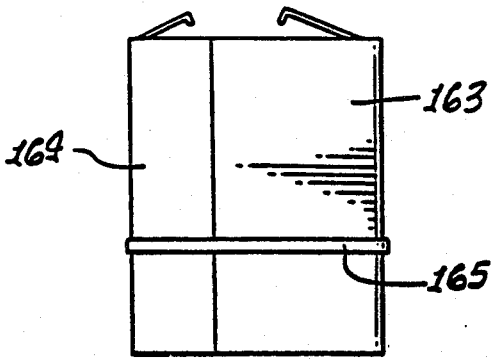
Figure 19C:
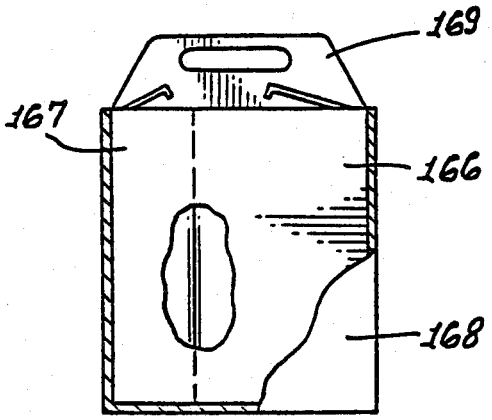
Figure 19D:
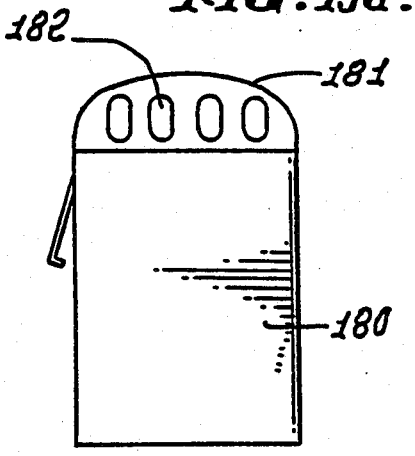

In FIG. 18, the carton 89 (as for example cardboard) contains detergent such as dry granules seen at 90. A pour spout appears at 91. The fitment 16 is carried in a separate compartment 92 defined by the carton, as for example by carton walls 93–95 at the top of the carton. A flap 96 is releasable to allow fitment removal.

Other possible ways of achieving the fitment using a carton are:

(1) Twin detergent and bleach, and activator, cartons as shown at 160 and 161 in FIG. 19(*a*) attached face-to-face, top-to-bottom, or side-to-side using glue, double-sided tape, or Velcro strip, indicated at 162;

(2) Twin detergent and bleach, and activator, cartons 163 and 164 banded together with tape, pressure sensitive sticker shrink wrap plastic, foil or paper overwrap, or a plastic sleeve, all of which are represented by band 165, in FIG. 19(*b*);

(3) Twin detergent and bleach, and activator, cartons 166 and 167 in an open-end paperboard sleeve, two pack carrier or tray, represented by carrier 168 with handle 169, in FIG. 19(*c*);

(4) A single carton containing two (detergent and bleach, and activator) plastic bags, also as represented in FIG. 19(*c*);

(5) A single detergent and bleach carton 180 with a domed plastic overcap 181 containing the activator, such as tablets 182.

Other fitment designs are possible, and it is not intended that this invention be limited to the designs described in these Figures.

BLEACH BASE COMPOSITION

Suitable compositions of the unactivated bleach base for this invention are well known in the industry, and can take conventional form, provided that the oxygen bleaching agent selected is capable of oxidizing halide ions to hypohalite and hypohalous acid. Of special interest in this regard is a triple salt of potassium peroxymonosulfate, potassium bisulfate, and potassium sulfate in the mole ratio of about 2:1:1, which is commercially available as Oxone, marketed by DuPont. Another bleaching agent, which has a sufficiently high oxidation potential for this application is magnesium monoperoxyphthalate, which is commerciallyavailable as H-48, marketed by Interox.

When incorporated in a spray dried detergent, the peroxygen bleach is ideally post-added to the spray dried product, thus avoiding decomposition in the high processing temperatures. When added to a dry mixed detergent, the peroxygen bleach may generally be added when convenient but in either case the particle size of the peroxygen bleach must be selected to conform to the particle size of the rest of the detergent in order to permit uniform mixing and avoid later segregation.

DETERGENT BASE

The base can be formulated to contain phosphate either as a sequestrant (e.g. sodium tripolyphosphate) or as a precipitative builder (e.g. tetrasodiumpyrophosphate). A particularly attractive variant, however, is to formulate the base without any inorganic phosphate enabling a single version of the product to be sold throughout the country, including areas which restrict or disallow the sale of laundry products containing phosphate. The selection of an appropriate builder system is of special importance in this application since the wash solution pH can dramatically affect the bleaching performance which results. Elevated pH's (e.g. in the range of 9.2–10.2) enhance the performance of all oxygen bleaching agents; and also the detergency on many bleach resistant soils. Consequently, alkaline detergent/bleach combinations which are well buffered in this range are especially preferable when the unactivated bleach base is used. The activated version however, is even more effective at somewhat lower pH's (e.g. in the range of 8.5–9.5), due to the resulting increase in the ratio of hypohalous acid to hypohalite. It is therefore highly desirable to formulate the base to achieve a mid-range pH (e.g. about 9.2 to 9.5) in the wash water of a washing machine, providing effective bleaching performance both with and without activation. Another important variant is a weakly buffered base composition, coupled with the addition of a solid highly acidic substance in the activator (e.g. sodium bisulfate). It is necessary even in this approach to include an alkalinity source since the peroxymonosulfate triple salt is itself acidic.

Depending on which of these goals is desired, appropriate builder compounds include pyrophosphates, tripolyphosphates, orthophosphates, carbonates, silicates, sesquicarbonate, bicarbonate, borates, zeolites, citrates, tartrate, gluconate, CMOS, EDTA, and NTA. Detergent builders will typically be present in aggregate amounts of 5% to 50% of the total product, but in highly condensed products may comprise up to about 80%.

The detergent will also contain one or more surfactants, usually comprising from about 5% to about 30% of the total product.

Surfactants are classified as anionics, nonionics, cationics, amphoterics and zwitterionics. The anionic and nonionic surfactants find the greatest utility in laundry detergents. Suitable surfactants are described in "McCutcheon's Emulsifiers & Detergents, N. American Edition 1983" and are listed by trade name and chemical type. Suitable anionic surfactants include organic sulfonates, sulfates, phosphate and phosphonates which contain hydrophilic as well as lipophilic groups. These include, for example, linear higher alkyl benzene sulfonates, higher olefin sulfonates, higher alkyl sulfonates, higher paraffin sulfonates, higher alcohol sulfates, the sulfates of condensations of higher alcohols and lower alkylene oxides, and the fatty acid soaps. The higher alkyl chain lengths will generally be from 12 to 18 atoms. The salt forming cations of these compounds are usually alkali metal cations, ammonium, amines or alkanolamines.

Useful nonionic surfactants include those surface active agents possessing both lipophilic and hydrophilic groups which do not ionize in water. Suitable nonionic surfactants are the polyoxyalkylene alkylphenols wherein the hydrophobic group contains a phenolic nucleus having a substituent alkyl group of at least 4 but preferably 8–12 carbon atoms and the hydrophilic portion is composed of at least 3 but preferably 6–100 moles of ethylene oxide or propylene oxide per mole of alkylphenol.

Also, suitable nonionic detergents are the polyoxyalkylene alcohols wherein the hydrophobic group is derived from natural or synthetic primary or secondary straight chain fatty alcohols having about 8–22 carbon atoms and the hydrophilic group is composed of at least 3 but preferably 5–100 moles of ethylene oxide or propylene oxide.

Other suitable nonionics are the polyalkylene esters of the higher organic acids usually having 8 or more carbon atoms in the acid hydrophobe and 10 or more moles of ethylene oxide as the hydrophilic group.

Further suitable nonionics are the polyalkylene alkylamides having a hydrophobic group derived from an amide of a fatty acid or ester. Similarly, the polyalkylene alkyamines whose hydrophobic group is from a primary, secondary or tertiary amine and whose ethylene oxide content is sufficiently high to impart both water solubility and nonionic characteristics in neutral or alkaline environments.

A further class of suitable nonionics are the fatty acid esters of polyols including glycols, glycerols, polyglycerol, hexitols and sugars and their polyoxyethylene condensates.

An additional group of suitable nonionic detergents are the polyalkylene oxide block copolymers made by condensing alkylene oxides with a hydrophobic base, itself obtained by condensing alkylene oxides with a reactive organic molecule.

Further suitable types of nonionic detergents include fatty alkanolamides, amine oxides, phosphine oxides, acetylenic glycols, and polyoxyethylene acetylenic glycols.

The base detergent may also contain from 0.1% to about 5% of detergent enzymes. Enzymes find use in laundering products in treating protein or starch base soils which are not readily removed by the other ingredients. The enzymes catalyze the breakdown of the soil into simpler compounds that can be washed away in the laundering process. Enzymes suitable for use in detergents are well described in the patent literature and generally are alkaline or neutral pH stable protease and/or amylases. Examples are the Esperases and Termamyl enzymes manufactured by Novo Industries A/S of Copenhagen, Denmark and the Maxacal and Maxamyl enzymes manufactured by Gis-Brocades NV. of Delft, Holland. Although effective in the presence of peroxygen bleaches, enzymes will be denatured by halide activation of them.

Another functional class of ingredients normally present in laundry detergents which may be be included in the detergent composition of this invention are intended to inhibit the redeposition of soil on fabric. These anti-redeposition agents may be present from 0.01% to 3% in the detergent and will be selected from the group including sodium carboxymethyl cellulose, sodium hydroxybutylethylcellulose, sodium hydroxypropylmethyl cellulose, polyacrylic acid salts, polyvinylacetate, polyvinyl pyrillidine and the like.

In contrast to the system of Gray (U.S. Pat. No. 4,028,263) requiring special stable fluorescent whitening agents, the nearest composition may employ any of these commonly in use, but those fluorescent whitening agents more effective in the presence of hypohalite bleaches are preferred.

Also present may be appropriate levels of dyes, perfumes, anti-caking agents, fillers and diluents.

ACTIVATOR

The activator portion of this invention can contain any or a mixture of the possible chloride and bromide salts. While a wide variation of chloride to bromide ratios are possible, a particularly advantageous combination is represented by 8 Gm. of sodium chloride and 4 Gm. of sodium bromide per wash load of 16 gal. water in the presence of a detergent containing 20 ppm. available oxygen contributed by potassium monopersulfate. The positive synergism between the chloride and bromide salts was demonstrated in a Tergotometer tea bleaching study at 90° F., using water of 150 ppm. hardness, with a commercial phosphate based household laundry detergent at the suggested level (0.15%), and Oxone at 20 ppm available oxygen. The scaled down equivalent of an eight gram sodium chloride tablet yielded 3% added tea bleaching; and the equivalent of a four gram sodium bromide tablet yielded 19% added tea bleaching. When both of these ingredients were added together (at the previous levels) however, the yield was 27% more tea bleaching, significantly greater than the sum of the two used alone. Tea bleaching is the tea stain removal due to the bleaching system corrected for the stain removal due to the detergent alone, based on reflectometer measurements on tea-stained cloth before and after washing.

$$\% \text{ stain removal} = \frac{R_w - R_s}{R_o - R_s} \times 100$$

where $R_o$ is reflectance of unsoiled fabric $R_s$ is reflectance of tea-stained fabric before washing $R_w$ is reflectance of tea-stained fabric after washing.

In a similar Tergotometer tea bleaching study, 0.13% of a no-phosphate household laundry detergent containing Oxone to produce 10 ppm available oxygen in the wash water resulted in 9% tea bleaching. When the equivalent of 4 gram of sodium bromide was added, 4% more tea bleaching resulted. The addition of the equivalent of 8 grams of sodium chloride produce 5% more tea bleaching. When both sodium bromide and sodium chloride were used together at the previous levels, 15% more tea bleaching was produced. In this same system, the addition of an 8 gram equivalent of sodium bromide yielded a bleaching increase of 29% and the addition of 8 gram equivalents of both sodium bromide and sodium chloride resulted in 41% added tea bleaching. Other halide salts may be found to exhibit similar performance synergism, but the importance of this particular combination is reinforced by other considerations. The cost of sodium chloride is approximately one-thirtieth that of sodium bromide. Also, although neither compound would be considered seriously toxic, they both have LD50's below 5 gram/kilogram. The toxicity of the mixed halides however, should be somewhat reduced, which is a highly desirable result when intended for household use.

Since the activation due to chloride alone is seen to be minimal, a convenient approach is to incorporate the chloride in the base detergent and to employ a 4 gram tablet or packet of sodium bromide as the effective activator, acting in synergistic concert with the chloride already present.

The relative levels of bromide salt and chloride salt in the activator are affected by the amount of space available, the number of activations included per package, the magnitude of effect per use, and the amounts of minor ingredient(s) included. If this combination of factors does not restrict the the space available for the activator, the preferred embodiment of this invention would be to include a high concentration of chloride salt relative to the bromide salt, thereby maximizing the synergistic advantage of the two in concert. In such a product, the weight of chloride salt may actually exceed the weight of bromide salt by as much as ten to one. If on the other hand, the amount of activator to be included is space limited then much smaller concentrations of chloride salt would be appropriate. In such an application, the chloride may actually be omitted entirely; forfeiting the positive synergism, lower cost, and any toxicity advantage.

Even extremely small amounts of sodium bromide alone have been shown to produce noticeable activation under typical wash conditions (e.g. as little as one gram in a 16 gallon wash load with 20 ppm available oxygen at 90° F.). There are consequently many possible ways through which it can be introduced. Large tablets (i.e. 6–20 grams) would be suitable for use in a product positioned as a dual action bleach, which would be designed to either be activated or unactivated with no adjustability between the two extremes. Smaller tablets (of about four grams) could be provided with instructions to use several on durable fabric/dyes, which have severe staining; and fewer for less extreme applications. Alternatively, single-scored 8 gram tablets could be provided to afford convenient selection of activation level desired in 4 gram increments. Granules can be provided either in a shaker or with a measuring cap, enabling the consumer to fine tune the activation. This will also speed dissolution by increasing the surface area to volume ratio. Another suitable vehicle for the halide salt activator is an aqueous solution contained in a squeeze or dropper bottle, offering immediate dissolution.

Other useful components of the activator besides halide salts include solid acidic compounds (e.g. sodium bisulfate) to reduce the pH of the activated wash solution; and agents to speed dissolution, such as starch which swells, fragmenting the tablet; or a combination of citric acid and sodium bicarbonate, causing effervescence with similar results. Examples of Activator Formulations:

| | Weight % | | | | | | |
|---|---|---|---|---|---|---|---|
| Ingredient | I | II | III | IV | V | VI | VII |
| Sodium Bromide | 100 | 50 | 20 | 20 | 60 | 75 | 40 |
| Sodium Chloride | — | 50 | 80 | 75 | 35 | — | 10 |
| Citric Acid | — | — | — | — | 3 | — | — |
| Sodium Bisulfate | — | — | — | — | — | 20 | — |
| Sodium Bicarbonate | — | — | — | — | 2 | — | — |
| Corn Starch | — | — | — | 5 | — | 5 | — |
| Water | — | — | — | — | — | — | 50. |

The above examples of activator formulations are intended to demonstrate the wide range of possible systems. In each, any alkali metal salt of bromide or chloride may be substituted for the sodium salt. Other starches may be used in place of corn starch and a number of alternate acid/carbonate systems may be employed to provide effervescence to help speed disintegration of the tablet in water. Examples I through VI may be executed in tablet form, Examples I, II, III, IV and VI may also be provided in the form of granules or powders in a sealed packet while Example VII represents the previously mentioned option of an aqueous solution of activator. Example VI demonstrates the use of sodium bisulfate to lower the pH of the activated system thereby increasing the resulting activation.

These halide-activated peroxygen dual strength bleach systems may be incorporated in any alkaline built laundry detergent. Examples of such detergent formulations incorporating peroxygen bleaches capable of being activated by the activators described are:

| | Weight % | | | | | | |
|---|---|---|---|---|---|---|---|
| Ingredient | I | II | III | IV | V | VI | VII |
| Potassium monopersulfate (Oxone) | 10 | 20 | 20 | 20 | 20 | 20 | 20 |
| Sodium linear alkyl benzene sulfonate | 20 | 20 | 20 | — | 20 | 20 | — |
| Ethoxylated nonylphenol | — | — | — | 10 | — | — | 10 |
| Ethoxylated fatty alcohol sulfate | — | — | — | 5 | — | — | 5 |
| Sodium silicate (1:2.4 ratio) | 10 | 10 | 10 | 10 | — | — | — |
| Sodium metasilicate (1:1 ratio) | — | — | 10 | — | — | 15 | 15 |
| Sodium chloride | 20 | — | 10 | 10 | 10 | 10 | 15 |
| Sodium carbonate | 25 | 45 | 25 | 44 | — | — | — |
| Sodium tripolyphosphate | — | — | — | — | 30 | 30 | 34 |
| Fluorescent whitening agents | 0.1 | 0.1 | 0.1 | 0.1 | 0.1 | 0.1 | 0.1 |
| Antiredeposition agents | 0.6 | 0.6 | 0.6 | 0.6 | 0.6 | 0.6 | 0.6 |
| Anticaking agents | 0.2 | 0.2 | 0.2 | 0.2 | 0.2 | 0.2 | 0.2 |
| Perfume | 0.1 | 0.1 | 0.1 | 0.1 | 0.1 | 0.1 | 0.1 |
| Sodium sulfate | q.s | q.s | q.s | — | q.s | q.s | —. |

These examples are intended to illustrate only a few of the many types of detergent formulas, containing alkaline builders, which are suited for incorporation of an activatable peroxygen bleach. Illustrated are both phosphate and non phosphate systems; both linear alkyl benzene sulfonate systems well suited for spray drying and nonionic-ethoxysulfate systems suitable for dry mixed or agglomerated preparations. Also shown are both high, medium and zero sodium chloride levels providing for flexibility in selecting the specific degree of chloride/bromide activation desired. Varying degrees of alkalinity are demonstrated: I employs lower levels of sodium carbonate as the alkalinity source; II and IV illustrate the use of higher sodium carbonate levels; III uses a combination of sodium carbonate and metasilicate; VI and VII demonstrate the utility of metasilicate in elevating the alkalinity of sodium tripolyphosphate systems.

The effects of activation of some of the above examples are shown in the following table. All of the data below represent % tea stain removal at 90° F. in 150 ppm water when the detergent was used at 0.13%, and sodium bromide added at 0, 10, and 20% on weight of detergent to the Tergotometer solution. These levels of activation correspond to the use of 0, 8, and 16 grams of sodium bromide, respectively, in a normal household wash.

| Detergent Formula | % Tea Stain Removal | | |
|---|---|---|---|
| | 0% NaBr | 10% NaBr | 20% NaBr |
| I | 17 | 36 | 45 |
| II | 20 | 56 | 65 |
| III | 21 | 58 | 68 |
| V | 14 | — | 69 |
| VI | 16 | — | 73. |

Figure 20A:
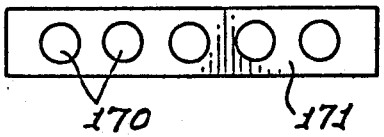
FIGS. 20*a*–20*c* show activator tablets and granules packaged for carriage by bleach containers.
Figure 20B:
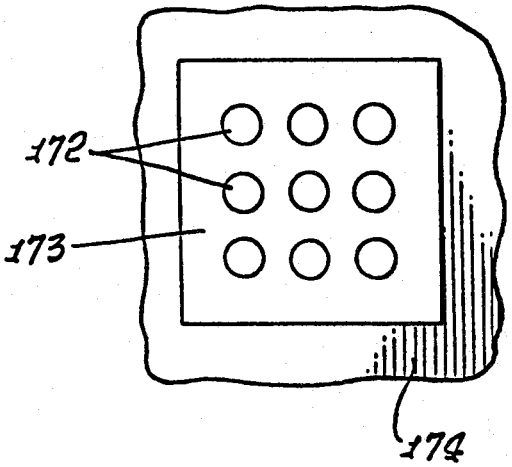
Figure 20C:
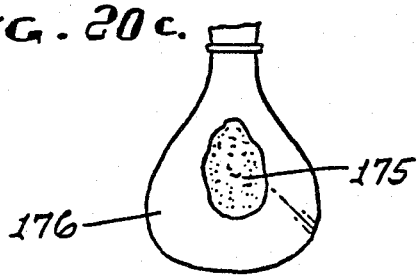

There are a number of additional or variant ways in which the activator can be included in the product, and yet physically isolated from the bleach base, including:

(1) A dial type tablet dispenser molded into the top of the overcap, as in FIG. 14 but with tablets at 17;

(2) Tablets in a strip pack, (see FIG. 20*a*, with tablets 170 removable from strip 171, to be coiled and received in bottle cap), (3) Tablets in a punch-out card, (see FIG. 20(*b*) showing tablets 172 removable from card 173 carried by and removable from bleach carton 174), (4) Water soluble pouches of loose granules, (see FIG. 20(*c*) showing granules 175 within pouch 176 insertible within a dry bleach bottle or carton), (5) Halide granules in vial, with cap for measuring (see FIGS. 5 and 6), (6) Halide solution in vial, with cap for measuring (see FIGS. 5 and 6).

Both the bleach base container and the activator container can be made from any suitable material including polyethylene, polypropylene, polyvinyl chloride and other plastic, glass, metal, or paperboard. In the case of paperboard, a suitable moisture barrier would be advantageous to maintain good flow characteristics after prolonged storage in humid environments.

The activator packaged in tablet form may comprise a dispenser hung on a bleach bottle neck, or attached to the exterior of a bleach carton (as for example as described above), or enclosed in a carton and supported on the dry bleach therein.

In the above description of bleach bottle and activator fitment examples, the bottle cap may define a first predetermined bleach fill volume, and the fitment sub-container cap may define a second predetermined activator fill volume. Such fill volumes may then define a measuring system characterized in that the amount of activator (filled into the sub-container cap) to be mixed with a selected amount of bleach (filled into the bottle cap) for most effective activation of the bleach in the wash water is determined by a predetermined established ratio of the two fill volumes. In this regard, the bleach activator composition may have one of the following forms: tablets, granules, water soluble packets, and solution.

It will also be understood that the bottle, as at 10 and/or 10*a* may have a transparent (glass, plastic, etc.) side wall for viewing of the bottle contents, and that the fitment dispensing container (as for example at 16) may extend within the bottle to an extent such that the dispensing container can be seen sidewardly through the bottle side wall. In this regard, the dispensing container may also have a transparent side wall (16*a*, for example) whereby the composition in the dispensing container 16 can also be seen through both such transparent side walls.

We claim:

1. A laundry aid package comprising, in combination:

(a) a first openable container containing a bleach base that includes a peroxygen bleaching agent for use in home laundering of fabrics, and a first halide salt or salts, (b) a dispensing container containing a bleach activator composition including a second halide salt or salts and forming a fitment, (c) the fitment carried by the first container to be readily detachable at least in part for dispensing the activator composition to controllably activate the bleach forming hypohalites at the time of fabric laundering.

(d) the first container being a bottle having a removable cap, the bottle having a neck and the cap having a top wall and a depending skirt that extends in interfitting threaded relation with said neck, and the fitment being retained by said cap top wall, (e) the fitment dispensing container cap being presented at the exterior side of the cap top wall for removal to gain access to the dispensing container contents irrespective of whether the bottle cap is on the bottle neck or removed therefrom, (f) the major portion of said dispensing container and the major portion of the contents thereof being located below the top level of said bottle neck, and extending within said neck but spaced inwardly from the neck.

2. The combination of claim 1 wherein the first and second halide salt or salts are selected from the group consisting of chloride salts and bromide salts of an alkali metal or metals.

3. The combination of claim 1 wherein the first halide salt or salts consists of chloride salt or salts of an alkali metal or metals, and the second halide salt or salts consist of a bromide salt or salts an alkali metal or metals.

4. The combination of claim 1 wherein the peroxygen bleaching agent is selected from the group consisting of potassium peroxymonosulfate; magnesium monoperoxyphthalate; and a mixture of potassium peroxymonosulfate, potassium bisulfate and potassium sulfate in the mole ratio of about 2:1:1.

5. The combination of claim 1 wherein the bleach base is admixed with laundry detergent, in the first container.

6. The combination of claim 1 wherein the bleach base is incorporated in an admixture consisting essentially of one of the following compositions I, II, III, IV, V, VI, and VII, wherein ingredient weight percentages are about the same as those listed:

| Ingredient | Weight % | | | | | | |
|---|---|---|---|---|---|---|---|
| | I | II | III | IV | V | VI | VII |
| Potassium monopersulfate (Oxone) | 10 | 20 | 20 | 20 | 20 | 20 | 20 |
| Sodium linear alkyl benzene sulfonate | 20 | 20 | 20 | — | 20 | 20 | — |
| Ethoxylated nonylphenol | — | — | — | 10 | — | — | 10 |
| Ethoxylated fatty alcohol sulfate | — | — | — | 5 | — | — | 5 |
| Sodium silicate (1:2:4 ratio) | 10 | 10 | 10 | 10 | — | — | — |
| Sodium metasilicate (1:1 ratio) | — | — | 10 | — | — | 15 | 15 |
| Sodium chloride | 20 | — | 10 | 10 | 10 | 10 | 15 |
| Sodium carbonate | 25 | 45 | 24 | 44 | — | — | — |
| Sodium tripolyphosphate | — | — | — | — | 30 | 30 | 34 |
| Fluorescent whitening agents | 0.1 | 0.1 | 0.1 | 0.1 | 0.1 | 0.1 | 0.1 |
| Antiredeposition agents | 0.6 | 0.6 | 0.6 | 0.6 | 0.6 | 0.6 | 0.6 |
| Anticaking agents | 0.2 | 0.2 | 0.2 | 0.2 | 0.2 | 0.2 | 0.2 |
| Perfume | 0.1 | 0.1 | 0.1 | 0.1 | 0.1 | 0.1 | 0.1 |
| Sodium sulfate | q.s | q.s | q.s | — | q.s | q.s | —. |

7. The combination of claim 1 wherein the second halide salt or salts is or are selected from the group consisting of:

(A) A mixture of bromide and chloride salts of an alkali metal or metals; and (B) A bromide salt or salts of an alkali metal or metals.

8. The combination of claim 7 wherein the activator composition also includes at least one of the following: citric acid, sodium bisulfate, sodium bicarbonate, corn starch, and water.

9. The combination of claim 1 wherein the second halide salt or salts consist of a mixture of bromide and chloride salts of an alkali metal or metals, and wherein the weight ratio of of chloride salt to bromide salt is within the range $\frac{1}{4}$ to 4/1.

10. The combination of claim 1 wherein the activator composition consists essentially of one of the following compositions I, II, III, Iv, V, VI and VII, wherein ingredient weight percentages are about the same as those listed:

| | Weight % | | | | | | |
|---|---|---|---|---|---|---|---|
| Ingredient | I | II | III | IV | V | VI | VII |
| Sodium Bromide | 100 | 50 | 20 | 20 | 60 | 75 | 40 |
| Sodium Chloride | — | 50 | 80 | 75 | 35 | — | 10 |
| Citric Acid | — | — | — | — | 3 | — | — |
| Sodium Bisulfate | — | — | — | — | — | 20 | — |
| Sodium Bicarbonate | — | — | — | — | 2 | — | — |
| Corn Starch | — | — | — | 5 | — | 5 | — |
| Water | — | — | — | — | — | — | 50. |

11. The combination of claim 5 wherein the detergent and bleach base provide a pH in the range of about 9.2 to 9.5 in the wash water of a washing machine.

12. The combination of claim 5 wherein the detergent includes (a) surfactant selected from the group consisting of anionic and nonionic surfactants, (b) and builder salt.

13. The combination of claim 12 wherein said anionic surfactant group includes linear higher alkyl benzene sulfonates, higher olefin sulfonates, higher alkyl sulfonates, higher paraffin sulfonates, higher alcohol sulfates, sulfates of condensation of higher alcohols and lower alkylene oxides, and fatty acid soaps.

14. The combination of claim 12 wherein said nonionic surfactant group includes:

(i) polyoxyalkylene alkylphenols wherein the hydrophobic group contains a phenolic nucleus having a substitutent alkyl group of at least 4 but preferably 8–12 carbon atoms and the hydrophilic portion is composed of at least 3 but preferably 6–100 moles of ethylene oxide or propylene oxide per mole of alkylphenol, (ii) polyoxyalkylene alcohols wherein the hydrophobic group is derived from natural or synthetic primary or secondary straight chain fatty alcohols having about 8–22 carbon atoms and the hydrophilic group is composed of at least 3 but preferably 5–100 moles of ethylene oxide or propylene oxide, (iii) polyalkylene esters of the higher organic acids usually having 8 or more carbon atoms in the acid hydrophobe and 10 or more moles of ethylene oxide as the hydrophilic group, (iv) polyalkylene alkylamides having a hydrophobic group derived from an amide of a fatty acid or ester, (v) polyalkylene alkyamines whose hydrophobic group is from a primary, secondary or tertiary amine and whose ethylene oxide content is sufficiently high to impart both water solubility and nonionic characteristics in neutral or alkaline environments, (vi) fatty acid esters of polyols including glycols, glycerols, polyglycerol, hexitols and sugars and their polyoxyethylene condensates, (vii) polyalkylene oxide block copolymers made by condensing alkylene oxides with a hydrophobic base, itself obtained by condensing alkylene oxides with a reactive organic molecule (viii) fatty alkanolamides, amine oxides, phosphine oxides, actylenic glycols, and polyoxyethlene actylenic glycols.

15. The combination of claim 12 wherein the base contains between about 0.1% and 5.0% by weight enzyme.

16. The combination of claim 15 wherein the enzyme is selected from the group consisting of alkaline or neutral pH stable proteinases and/or amylases.

17. The combination of claim 5 wherein the base contain between about 0.01% and 3.0% by weight anti-redeposition agent.

18. The combination of claim 17 said anti-redeposition agent is selected from the group consisting of sodium carboxymethyl cellulose, sodium hydroxybutylethycellulose, sodium hydroxypropylmethyl cellulose, polyacrylic acid salts, polyvinylacetate, polyvinyl pyrillidine.

19. In the method of laundering fabric in wash water, the steps that include:

(a) providing a first volume of a bleach base that incorporates peroxygen bleaching agent, and a first halide salt or salts, a portion of which is to be added to the fabric laundry wash water, (b) providing a second volume of a bleach activator composition including a second halide salt or salts in close transported association with said first volume of bleach base for presentation at the time of laundering, (c) and separating some of said activator composition from said close association with the bleach base volume and applying same to controllably activate the bleach base in said wash water containing said added portion of the bleach base, (d) said first volume of bleach base being provided in a relatively large first container being a bottle having a removable cap, the bottle having a neck and the cap having a top wall and a depending skirt that extends in interfitting threaded relation with said neck and there being a fitment being retained by said cap top wall, (e) said second volume of bleach activator being provided in said fitment dispensing container substantially smaller than said relatively large container the fitment dispensing container integral with said bottle attached to the top of the sub-container, the fitment dispensing container cap being presented for removal to gain access to the dispensing container contents irrespective of whether the bottle cap is on the bottle neck or removed therefrom, (f) said (b) step including locating the fitment in the relatively large container, via said neck, (g) and gaining access to the fitment in the large container and via said neck so that said bleach activator may be applied to controllably activate the bleach base, and at the same time of also gaining access to the bleach base in the large container via said neck prior to said step (c) application of the bleach activator.

20. The method of claim 19 including adding said bleach base portion and fabric to the wash water in a washing machine and initiating operation of said machine to launder the fabric.

21. The method of claim 20 wherein the bleach base is formulated to have a pH of between about 9.2 and 9.5 in the wash water.

22. The method of claim 20 wherein the bleach activator consists essentially of a salt or salts selected from the group consisting of chloride salts and bromide salts of an alkali metal or metals.

23. The combination of claim 19 wherein the bleaching agent is capable of oxidizing halide ions to hypohalite and hypohalous acid, and is selected from the group consisting of (i) a triple salt of potassium peroxymonosulfate potassium bisulfate and potassium sulfate, (ii) magnesium monoperoxyphthalate.

24. The combination of claim 23 wherein the bleach base includes at least one of the following:

($x_1$) sodium tripolyphosphate ($x_2$) tetra sodium pyrophosphate ($x_3$) builder salt selected from the group consisting of pyrophosphate, tripolyphosphate, orthophosphate, carbonate, silicate, sesquicarbonate, bicarbonate, borate, zeolite, citrate, tartrate, gluconate, CMOS, EDTA and NTA ($x_4$) surfactant ($x_5$) fluorescent whitening agent ($x_6$) anti-redeposition agent ($x_7$) enzyme ($x_8$) dye ($x_9$) perfume ($x_{10}$) anti-caking agent ($x_{11}$) filler ($x_{12}$) diluent.

25. The method of claim 19, wherein the bleach activator composition has one of the following forms:

(i) granular (ii) tablets (iii) water soluble packet (iv) solution.

26. The combination of claim 1 wherein the bottle cap defines a first predetermined bleach base fill volume, and the fitment subcontainer cap defines a second predetermined activator fill volume, said fill volumes defining a measuring system characterized in that the amount of activator to be mixed with a selected amount of bleach base is determined by a predetermined established ratio of said fill volumes.

27. The method of claim 19 wherein the container has a first cap and the fitment has a second cap, and including the step of using said first cap to measure the relative quantities of said bleach base and of said activator composition, respectively, to be added to the wash water.

28. The combination of claim 1 wherein the bottle has a transparent side wall and the dispensing container extends within the bottle, whereby the dispensing container and the bleach base can be seen sidewardly through the bottle transparent side wall.

29. The combination of claim 28 wherein the dispensing container also has a transparent side wall, whereby the bleach activator can also be seen through both said transparent side walls.

* * * * *